United States Patent [19]

Pentz

[11] 4,070,152

[45] Jan. 24, 1978

[54] TEXTILE TREATING COMPOSITIONS FOR INCREASING WATER AND OIL REPELLENCY OF TEXTILES

[75] Inventor: Lipot Pentz, Baton Rouge, La.

[73] Assignee: Ciba-Geigy Corporation, Ardsley, N.Y.

[21] Appl. No.: 648,604

[22] Filed: Jan. 12, 1976

[51] Int. Cl.[2] ..... D06M 9/00; C08L 43/04

[52] U.S. Cl. ..... 8/115.6; 8/115.7; 8/116 R; 8/181; 8/DIG. 1; 252/8.8; 260/827; 427/390 E

[58] Field of Search ..... 260/827

[56] References Cited

U.S. PATENT DOCUMENTS

| | | | |
|---|---|---|---|
| 2,976,257 | 3/1961 | Dawe | 260/14 |
| 3,062,764 | 11/1962 | Osdal | 260/29.3 |
| 3,317,629 | 5/1967 | Quaal | 260/827 |
| 3,346,443 | 10/1967 | Elmer | 161/184 |
| 3,385,812 | 5/1968 | Brahcman | 260/29.6 |
| 3,770,687 | 11/1973 | Mestetsky | 260/30.4 SB |
| 3,816,235 | 6/1974 | Lin | 161/175 |

*Primary Examiner*—Paul Lieberman

*Attorney, Agent, or Firm*—Karl F. Jorda; Edward McC. Roberts; Prabodh I. Almaula

[57] ABSTRACT

Disclosed are compositions comprising a textile treating resin and a novel copolymer of a maleic-anhydride copolymer and a fatty acid amine and an aminoorganopolysiloxane. Said compositions are useful for increasing the water and oil repellency of substrates such as textiles, paper, leather and the like.

12 Claims, No Drawings

TEXTILE TREATING COMPOSITIONS FOR INCREASING WATER AND OIL REPELLENCY OF TEXTILES

This invention is directed to new copolymers and a method for their manufacture. The present invention is also related to the use of these copolymers as extenders for textile treating resins and a process for treating textiles with mixtures of copolymers and textile treating resins in order to increase their water and oil repellency. This invention also relates to a substrate containing from about 0.2% to 2.0% by weight of a textile treating resin and from about 0.1% to 10% by weight of the new copolymer. The term extenders as used herein means that these copolymers enhance the oil and water repellency of textiles treated with textile treating resins.

Although textile treating resins are readily available, it is well known that they are somewhat expensive. Their expense has been the primary reason for their lack of widespread commercial acceptance. Also when they are employed for the treatment of textiles, they suffer from the disadvantage that there is a significant loss of water and oil repellency on washing or dry cleaning the textiles. Surprisingly, it was found that the new copolymers when used as mixtures with textile treating resins for treating textiles increased significantly their water and oil repellency. Unexpectedly, it was also found that a significantly smaller amount of textile treating resins is required as part of the mixture because of the extenders, for imparting oil and water repellency to the textile, whereas larger amounts are required when used alone. Thus, the resulting advantage is that there is a considerable reduction in cost for treating textiles with the above mixture. An additional advantage is that materials rendered oil and water repellent by these mixtures retain a significant portion of the original repellency when laundered or dry cleaned.

The new polymers are copolymers of N-substituted maleamic acid obtained from reacting I a maleic-anhydride copolymer having repeating units of the general formula

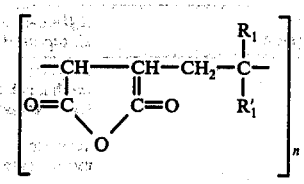

wherein each of $R_1$ and $R_1'$ is hydrogen, lower alkyl, lower alkoxy, or aryl and $n$ is an integer from 2 to 500, (II) an amine derived from fatty acid and of the formula $$CH_3\text{-}(CH_2)_n\text{-}NH_2$$

wherein $p$ is an integer from 7 to 28, and (III) an aminoorganopolysiloxane of the formula

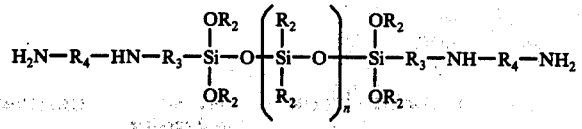

wherein $R_2$ is lower alkyl, $R_3$ and $R_4$ are each lower alkylene and $n$ is an integer from 5 to 28.

The term textile treating resins as used herein denotes fluorine-containing polymers of any polymeric or polymer-forming perfluoroalkyl ($=R_f$) group containing compound, which can be used to impart oil or water repellency to a textile fabric. The fluorine containing polymers are known and typically, they fall into two categories; namely, addition polymers or condensation polymers.

The addition polymers are prepared by polymerization or copolymerization with suitable monomers of $R_f$-substituted unsaturated monomers capable of free radical or ionic polymerization such as: $\alpha$-$\beta$-unsaturated acids, acrylates, methacrylates, maleates, fumarates, itaconates, vinylethers, vinylesters, alkylesters and styrene.

Typical examples of $\alpha,\beta$-unsaturated $R_f$-substituted compounds include:

| $R_f$-active H Compound | $\alpha,\beta$-unsaturated Compound | Patent Information | Company |
|---|---|---|---|
| $R_fSO_2N(R')-R-CH_2OH$ ($R'=C_1-C_6$) ($R-C_1-C_{12}$) | acrylate methacrylate | 2803615 | 3M |
| $R_fSO_2N(R')-R-CH_2OH$ ($R'=C_1-C_6$) ($R-C_1-C_{12}$) | fumarate maleate itaconate | 3736300 | CIBA-GEIGY |
| $R_fCH_2CH_2OH$ | acrylate methacrylate | 3282905 3378609 | DuPont |
| $R_fCH_2OH$ | acrylate methacrylate | 3256230 | DuPont |
| $R_f-C(=O)-N(R^1)-A-NH(R^2)$ | acryl-methacryl amides | 3428709 | CIBA-GEIGY |
| $(CF_3)_2CH-OH$ | acrylate methacrylate | 3304198 | Allied Chemical |
| $(CF_3)_2CF-OH$ | acrylate methacrylate | 3384628 | Secretary of Agriculture |

-continued

| $R_f$-active H Compound | α,β-unsaturated Compound | Patent Information | Company |
|---|---|---|---|
| $R_fC(=O)-N(R)-H$ | acrylate methacrylate hydroxamate | 3412142 | CIBA-GEIGY |
| $(F_3C)_2CF$ 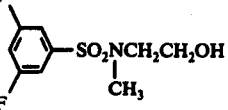 $(CF_3)_2CF$ | acrylate methacrylate | 3407183 | Allied Chemical |
| $R_f-O-(CH_2CH_2O)_nH$ n = 1-11 | acrylate methacrylate | Br1130822 | ICI |
| $R_fO-C_6H_4-CH_2OH$ | acrylate methacrylate | Br1130822 | ICI |
| $(F_3C)_2CFO(CH_2)_nOH$ | acrylate | 3424285 | USDA |
| $R_fSO_2N(CH_3)CH_2-C_6H_4-CH_2OH$ | acrylate methacrylate | 3728151 | 3M |
| $R_fSO_2CH_2CH_2OH$ | | | |
| $R_fSOCH_2CH_2OH$ | | | |
| $R_fCON(C_2H_5)-(CH_2)_2OH$ | | | |
| $(CF_3)_2CF(CF_2)_4CH=CH-CH_2OH$ | acrylate methacrylate | GB1101049 | Daikin Kogyo |
| $R_f-CH=CH-(CH_2)_xOH$ | acrylate methacrylate | Fr1473451 | 3M |
| $R_fCH_2CH(CH_3)-OH$ | acrylate methacrylate | 3384627 | Allied Chemical |
| $R_f(CH_2)_{1-11}-S-(CH_2)_{2-11}OH$ | acrylate methacrylate | 3686283 | FMC |

The condensation polymers are prepared from $R_f$-substituted alcohols, diols, epoxides, aziridines, amines, etc., by reaction with diacids, acid chloride, anhydrides, isocyanates by the known methods of polycondensation. Besides the compounds mentioned under (1) typical reactive $R_f$-chemicals especially suited for polycondensation include:

| $R_f$-Structure | Reactive Group | Patent | Company |
|---|---|---|---|
| $(CF_3)_2CF-CH_2-CH(O)CH_2$ | $R_f$-epoxy compounds | 3361685 | USAD |
| $R_fCH_2-O-CH_2CH(O)CH_2$ | " | 3079214 | USAD |
| $R_f-C(=O)-N(CH_2)_2$ | $R_f$-aziridyl compounds | 3300274 | USAD |
| $(N-C(=O)-R_f-C(=O)-N)$ | $R_f$-aziridyl compounds | 3300274 | USAD |
| $R_f(CH_2)_yC(=O)-N$ | $R_f$-aziridyl compounds | 3300274 | USAD |
| $R_f-Q-W-C(=N-C(NH_2)=N-C(NH_2))$ Z → $-SO_2NH(CH_2)_nNH-$, $-(ONH-$, $-SO_2N(R)-$, $-(CH_2)_n-O-$, $-CO-NH(CH_2)_mNH-$, $-(CH_2)_n-NH-$. | $R_f$-substituted amino triazines | 3128272 | 3M |

Typical Examples of Other $R_f$ Substituted Unsaturated Compounds Include:

| Structure | Unsaturated Type | Patent | Company |
|---|---|---|---|
| $R_fSO_2NR(R')OCH=CH_2$ | Vinylether | 3078245 | 3M |
| $R_fSO_2N(R')R-CO(=O)-CH=CH_2$ | Vinylester | 2841573 | 3M |

-continued

| Structure | Unsaturated Type | Patent | Company |
|---|---|---|---|
| $R_fSO_2N(R')R-\overset{O}{\overset{\|\|}{C}}-O-CH_2-CH=CH_2$ | Allyl (propenyly-ester | 2841573 | 3M |
| $R_f(CH_2)_3COOCH=CH_2$ | Vinylester | 2841573 | 3M |
| $R_fCOOCH_2-CH=CH_2$ | Allylester | 2841573 | 3M |
| $R_fSO_2\underset{\underset{CH_3}{\|}}{N}-CH_2-\overset{O}{\overset{\|\|}{C}}-CH=CH_2$ | Vinyl ketone | 2841573 | 3M |
| $R_fSO_2-\langle\bigcirc\rangle-CH=CH_2$ | Styrene | 2841573 | 3M |
| $R_fSO_2\underset{\underset{CH_3}{\|}}{N}-CH_2-\langle\bigcirc\rangle-CH=CH_2$ | Styrene | 2841573 | 3M |
| $R_fCONHCH=CH$ | Vinylamide | 3728151 | |
| $R_f-X-\underset{R}{\overset{+}{N}}(CH_2CH=CH_2)_2\ A^{\ominus}$ | Diallylammonium Compounds | 3717679 | Calgon |
| $R_fXNH(CH_2)_m\overset{+}{N}(R')(R'')-CH_2CH_2OH\ A^{\ominus}$ | Acrylate Methacrylate | 3207730 | 3M |
| $R_f-SO-_2\underset{\underset{C_2H_5}{\|}}{N}-CO-CH=CH_2$ | acryl sulfamido | 3728151 | 3M |

| $R_f$-Structure | Reactive Group | Patent | Company |
|---|---|---|---|
| $(CF_3)_2CF-CH_2-CH-CH_2$ (O) | $R_f$-epoxy compounds | 3361685 | USAD |
| $R_fCH_2-O-CH_2CH-CH_2$ (O) | | 3079214 | USAD |
| $R_f-\overset{O}{\overset{\|\|}{C}}-N$ ($CH_2$, $CH_2$) | $R_f$-aziridyl compounds | 3300274 | USAD |
| $N-\overset{O}{\overset{\|\|}{C}}-R_f-\overset{O}{\overset{\|\|}{C}}-N$ | $R_f$-aziridyl compounds | 3300274 | USAD |
| $R_f-Q-W-C$ (triazine ring, $NH_2$, $NH_2$, Z) → $-SO_2NH(CH_2)_nNH-$, $-SO_2\underset{\underset{R}{\|}}{N}-CO-NH(CH_2)_mNH-$, $-CONH-(CH_2)_n-O-$, $-(CH_2)_n-NH-$ | $R_f$-substituted amino-triazines | 3128272 | 3M |
| $R_f$, N, N, $(NH_2)$, $R_3$, $R_4$, N, N, $R_1$, $R_2$, $(-NH_2)$; $R_1$, $R_2$, $R_3$, $R_4$: at least 1 or 2 can be $NH_2$ | $R_f$-guanamines + mono-basic or dibasic acids (aceto-guanamines, glutaro-guanamines) | 3305390 | Amer Cyanamid |
| $R_1-CONH(CH_2)_n-$ ® $-(CH_2OR')_m$ | $R_f$-derivatives of amino-aldehyde compounds | 3362782 3296264 | Colgate |

-continued

| $R_f$-Structure | Reactive Group | Patent | Company |
|---|---|---|---|
| R': H, $CH_3$ H, $-CH_3$, $-C_2H_5$ | ® { ureas, di-heterocyclic ureas, triazines, guanamines } ® | | |
| $R_f-\overset{O}{\overset{\|}{C}}-\overset{R}{\overset{\|}{N}}-(R'O)_n-\overset{O}{\overset{\|}{C}}-N\begin{matrix}x\\y\end{matrix}$ | $R_f$-carbamates | 3427332 | Pennwalt |
| x,y: H, $-CH_2OH$, $-CH_2OCH_3$ | | | |
| $R_f-CONHCHRCOOH$ | perfluoro organic amido acid compounds + organometallic derivatives | 3382097 3377197 | Air Products |
| $H_2N-[(CH_2)_xN]-_y(CH_2)_x-NH_2$ ($(CH_2)_xNH_2$) | perfluoroalkyl substituted polyamides | 3420697 | Allied Chemical |
| $\boxed{+R_fCOOH}$ | | | |
| $R_f-CON(CH_2OH)_2$ | methylol-perfluoroalkanamides | 3322490 | Colgate |
| $R_f(CH_2)_nOH$ | condensation product with 2,4-TDI and t-aliphatic amine salt of sulfonic acid | 2917409 | DuPont |
| $R_f$-alcohols, -amines, -acids, -thiols, -phenols, -thiophenols: $R_fSO_2N(CW_3)-(CH_2)_5SH$; $R_fSO_2N(C_2H_5)-CH_2COOH$ | reaction products with diisocyanates $R_f$-urethanes | 3398182 | 3M |
| | bis-perfluoroalkyl ammonium phosphates | 3096207 | DuPont |
| | polyfluoroalkanamido phosphates | 3188340 | DuPont |
| | poly[bis(polyfluoroalkoxy)phosphonitriles | 3431140 | Amer Cyanamid |
| | fluoroalkylvinyl sulfones | 3406004 | |
| | $R_f$-orthotitanates | 3342630 | Colgate |
| $R_f-\overset{O}{\overset{\|}{C}}-NH-(CH_2)_x-Si(OR)_3$ | fluoroalkylamido-polysiloxan | GB1267224 | Nalco |
| $CH_2$ $C(CH_2OCF(CF_3)_2)_2$ $O-CH_2$ | poly 3,3-bis-(heptafluoroisopropoxymethyl)-oxetan | | |

One class of preferred fluorine containing polymer is a solution of a mixture of a perfluoroalkyl urethane and a copolymer of a perfluoroalkyl acrylate and a hydrocarbylacrylate in a halogenated solvent. The other class is a copolymer of $R_f$-fumarate mixture and ethylene-propylene-1,5-hexadiene terpolymer rubber and 4-hydroxybutylvinylether in a solvent mixture of tetrachloroethylene, 1,1,1-trichloroethane, 1,1,2-trifluoro-2-chloroethylene and acetone. The $R_f$-fumarate mixture is a mixture of bis(1,1,2,2-tetrahydroperfluoroalkyl)-fumarates, which are prepared by the telomerization of perfluoroalkyliodide with ethylene and the subsequent reaction of the telomer with fumaric acid in the presence of triethylamine to yield the desired diester. Also another class of preferred fluorine containing polymer is a butyl methacrylate polymer. This copolymer is obtained by the same process of preparing a copolymer of $R_f$-fumarate mixture and containing the same reactants and solvents as copolymer of $R_f$-fumarate mixture but instead of $R_f$-fumarate mixture is employed 1,1-dihydropentadecafluorooctyl methacrylate.

The maleic-anhydride copolymer (I) is of the formula

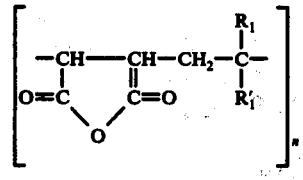

wherein each of $R_1$ and $R_1'$ is hydrogen, lower alkyl, lower alkoxy, or aryl and $n$ is an integer from 2 to 500. The term "lower" referred to above and described hereinafter denotes carbon atoms of 1 to 7, advantageously 1 to 4 and preferably 1 to 2. Illustrative alkyl group includes methyl, ethyl, propyl, $n$ or i-butyl and representative alkoxy groups include methoxy, ethoxy, propoxy, butoxy, etc. Illustrative aryl groups are phenyl, phenyl substituted by halogen, lower alkyl or lower alkoxy. The preferred copolymers on account of their commercial availability and facile method of synthesis are low molecular weight copolymers of maleic-anhydride-2-methoxypropene, maleic-anhydride-ethylene, maleic-anhydride-vinyl ether and maleic-anhydride-styrene. Their average molecular weight is from 3,000 to 50,000 with a ratio of weight to number average i.e., $M_w/M_n$ from 2 to 24. The maleic-anhydride copolymers are known or if unknown are prepared according to known analogues. Their method of preparation is described in U.S. Pat. Nos. 3,451,979, 3,755,264, 3,765,829 and almost all are available from Dupont, Monsanto, Arco and other chemical companies.

The amine compound II is of the formula $$CH_3\text{-}(CH_2)_p\text{-}NH_2$$

where $p$ is an integer from 7 to 28. Illustrative fatty amines are stearyl, hydrogenated tallow, cottonseed, lauryl, coco, tall oil, soybean, oleyl, cetyl, and arachidyl-behenyl. These amines are well known in the art and commercially available from Ashland and other well known chemical companies. The aminoorganopolysiloxane (III) is of the formula

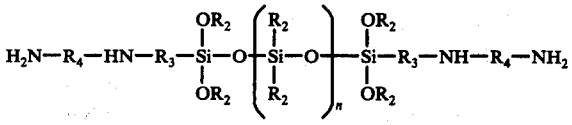

wherein $R_2$ is lower alkyl, $R_3$ and $R_4$ are each lower alkylene and $n$ is from 5 to 28. The value of integer $n$ depends on the viscosity desired and is such that it gives a viscosity of the aminoorganopolysiloxane in the range of about 10 to 10,000 cs. at 25° C. The alkyl groups are those described previously and the alkylene groups are methylene, ethylene, propylene, butylene, etc. One of the preferred class of III is when $R_2$ is methyl or ethyl, $R_3$ and $R_4$ are each methylene, ethylene, propylene or butylene and $n$ is from 5 to 20. They are all described in U.S. Pat. Nos. 3,508,933, 3,719,632, 3,737,336 and British Patent No. 1,296,136 and most of them are commercially available from Union Carbide Corporation and Dow Corning Corporation. While the viscosity of the aminoorganopolysiloxane is specified as being in the range of 10 to 10,000 cs., it should be noted that higher viscosities can be used. Generally a viscosity in the range of 20 to 200 cs is preferred, with the most preferred being 35, 80 and 150 cs. at 25° C.

Copolymers are those obtained from reacting, (I) a maleic-anhydride copolymer of the formula

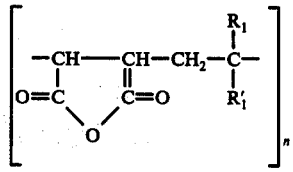

wherein each of $R_1$ and $R_1'$ is hydrogen, methyl, ethyl, methoxy, ethoxy, or phenyl and $n$ is from 2 to 500, (II) an amine derived from fatty acid and of the formula $$CH_3\text{-}(CH_2)_p\text{-}NH_2$$

wherein $p$ is from 12 to 26, and (III) an aminoorganopolysiloxane of the formula

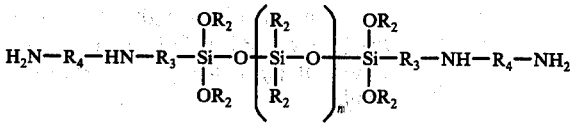

wherein $R_2$ is methyl, ethyl, propyl, butyl, $R_3$ and $R_4$ are each methylene, ethylene, propylene or butylene and $n$ is an integer from 5 to 20.

Most preferred copolymers are those obtained from reacting, (I) a maleic-anhydride copolymer selected from the group consisting of maleic-anhydride-2-methoxypropene, maleic-anhydride-ethylene, maleic-anhydride-methylvinyl ether and maleic-anhydride-styrene, (II) an amine selected from the group consisting of stearyl or hydrogenated tallow and (III) an aminoorganopolysiloxane wherein $R_2$ is methyl or ethyl, $R_3$ and $R_4$ are each methylene, ethylene or propylene and $n$ is from 5 to 28.

Outstanding copolymers on account of their usefulness are those obtained from reacting, (I) maleic-anhydride-2-methoxypropene copolymer, (II) a stearyl amine, and (III) an aminoorganopolysiloxane wherein $R_2$ is methyl, $R_3$ is propylene, $R_4$ is ethylene and $n$ is from 5 to 20.

The copolymers of the invention are prepared by refluxing in an inert atmosphere a copolymer of I with II and III in molar ratios, in an organic solvent inert to the reactants, and then cooling the solution whereby a viscous copolymer solution is obtained. The proportions of the maleic-anhydride copolymer (I) to the amines (II and III) may be varied, however it is preferable that maleic-anhydride copolymer and the amines be used in approximately equimolar proportions. The ratio of amine (II) to aminoorganopolysiloxane (III) may be in varying proportions, with component II preferably in excess. It is preferable that at least 8 or 9 moles of the amine (II) be used per 2 or 1 mole of aminoorganopolysiloxane (III). The solvents used are halogen containing hydrocarbons with 2 to 4 carbon atoms such ethylenedichloride, tetrachloroethylene, perchloroethylene, carbontetrachloride, hydrocarbons such as hexane, heptane, octane and higher homologs, cyclohexane, benzene, or substituted benzene, toluene, xylene; ethers both aliphatic and alicyclic including di-n-propyl ether, dibutyl ether, dioxane and tetrahydrofuran. In addition, blends of ether or hydrocarbons or halogen containing hydrocarbons can be employed. The preferred solvents are dioxane, toluene, tetrachloroethylene or benzene.

For example, a representative member of the copolymers, namely of maleic-anhydride-2-methoxypropene copolymer, stearyl amine and an aminoorganopolysiloxane of the formula (III) wherein $R_2$ is methyl, $R_3$ is propylene, $R_4$ is ethylene and $n$ is from 5 to 20, is prepared by refluxing the above components in dioxane in a nitrogen atmosphere for 3½ to 4 hours and then cooling the solution, whereby a viscous copolymer solution is obtained.

The starting materials for the synthesis of copolymers are known or can be synthesized by methods known in literature.

The copolymers of the invention are useful as compositions comprising mixtures of textile treating resins and said copolymers, for treating textile, paper, leather, and the like in order to increase their oil or water repellency.

More specifically, the copolymer mixture is directed to compositions comprising in a textile treating bath (a) from about 0.2% to about 2.0% by weight of a textile treating resin and (b) from about 0.15% to about 1% by weight of a copolymer of (I) a maleic-anhydride copolymer of the formula

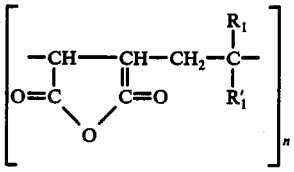

wherein each of $R_1$ and $R_1'$ is hydrogen, lower alkyl, lower alkoxy, or aryl, and $n$ is an integer from 2 to 500, (II) an amine derived from fatty acid and of the formula $$CH_3\text{-}(CH_2)_p\text{-}NH_2$$

wherein $p$ is an integer from 7 to 28, and (III) an aminoorganopolysiloxane of the formula

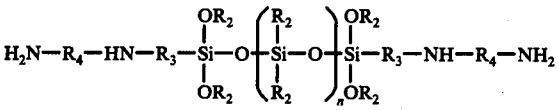

wherein $R_2$ is lower alkyl, $R_3$ and $R_4$ are each lower alkylene, and $n$ is an integer from 5 to 28.

A preferred composition is that comprising in a textile treating bath (a) from about 0.6% to about 1.8% by weight of a fluorine containing polymer and (b) from about 0.25% to about 0.75% by weight of a copolymer of (I), a maleic-anhydride copolymer of the formula

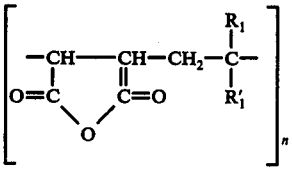

wherein each of $R_1$ and $R_1'$ is hydrogen, methyl, ethyl, methoxy, ethoxy, or phenyl, $n$ is from 2 to 500, (II) an amine derived from fatty acid and of the formula $$CH_3\text{-}(CH_2)_p\text{-}NH_2$$

wherein $p$ is an integer from 12 to 26, and (III) an aminoorganopolysiloxane of the formula

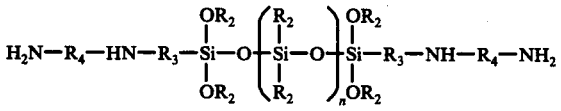

wherein $R_2$ is methyl, ethyl, propyl, butyl, $R_3$ and $R_4$ each are methylene, ethylene, propylene, or butylene and $n$ is an integer from 5 to 20.

The compositions produced according to the present invention are applicable to films, fibers, yarns, fabrics and articles made from filaments, fibers or yarns derived from natural, modified natural or synthetic polymeric materials or from blends of these. Specific examples are cotton, silk, regenerated cellulose, nylon, polyester/cotton, poplin, fiber-forming linear polyester, fiber-forming polyacrylonitrile, cellulose nitrate, cellulose acetate, ethyl cellulose, paper, fiberglass, and the like. Dyed and undyed cotton sateen, poplin, broadcloth, jean cloth, gabardine, and the like are also adaptable for treatment with the compositions of this invention to provide products having a high repellency to oil and water and being relatively unaffected by the action of heat, air and light. Materials rendered oil and water repellent by the invention copolymer composition retain a significant portion of the original repellent after many launderings and dry cleanings.

A most preferred composition is that comprising in a textile treating bath (a) from about 0.6% to about 1.1% by weight of a mixture of perfluoroalkyl urethane and a copolymer of a perfluoroalkyl acrylate and a hydrocarbylacrylate in a solvent or a copolymer of $R_f$-fumarate mixture and ethylene-propylene-1,5-hexadiene terpolymer rubber and 4-hydroxybutylvinylether in a solvent or a copolymer of 1,1-dihydropentadecafluorooctyl methacrylate and ethylene-propylene-1,5-hexadiene terpolymer rubber and 4-hydroxybutylvinylether in a solvent, and (b) from about 0.25% to about 0.75% by weight of a copolymer of (I) a maleic-anhydride copolymer selected from the group consisting of maleic-anhydride-2-methoxypropene, maleic-anhydride-ethylene, maleic-anhydride-vinyl ether and maleic-anhydride-styrene, (II) an amine selected from the group consisting of stearyl or hydrogenated tallow and (III) an aminoorganopolysiloxane wherein $R_2$ is methyl or ethyl, $R_3$ and $R_4$ are each methylene, ethylene or propylene and $n$ is from 5 to 20.

An outstanding composition is that comprising in a textile treating bath, (a) from about 0.6% to about 1.1% by weight of a mixture of perfluoroalkyl urethane and a copolymer of a perfluoroalkyl acrylate and a hydrocarbylacrylate in a solvent or a copolymer of $R_f$-fumarate mixture and ethylene-propylene-1,5-hexadiene terpolymer rubber and 4-hydroxybutylvinylether in a solvent or a copolymer of 1,1-dihydropentadecafluorooctyl methacrylate and ethylene-propylene-1,5-hexadiene terpolymer rubber and 4-hydroxybutylvinyl ether in a solvent and (b) from about 0.25% to about 0.75% by weight of a reaction product of (I) a maleic-anhydride-2-methoxypropene copolymer, (II) stearyl amine and (III) an aminoorganopolysiloxane wherein $R_2$ is methyl, $R_3$ is propylene and $R_4$ is ethylene and $n$ is from 5 to 20.

These compositions are applied to textiles, paper and the like by techniques well known in the art, for example by dipping, brushing, roll coating, spraying or padding a solution of the composition to the substrates or a combination of either of the above methods. The optimum method of application will depend principally on the type of substrate being coated. A general procedure involves depositing on the substrate a composition, comprising (a) from about 0.2% to about 2.0% by weight of a textile treating resin and (b) from about 0.15% to 1% by weight of a copolymer of (I) a maleic-anhydride copolymer of the formula

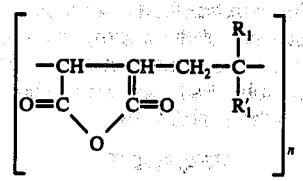

wherein each of $R_1$ and $R_1'$ is hydrogen, lower alkyl, lower alkoxy or aryl and $n$ is an integer from 2 to 500, (II) an amine derived from fatty acid of the formula $$CH_3\text{-}(CH_2)_p\text{-}NH_2$$

wherein $p$ is an integer from 7 to 28 and (III) an aminoorganopolysiloxane of the formula

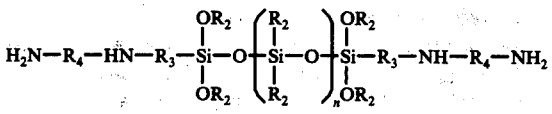

wherein $R_2$ is lower alkyl, $R_3$ and $R_4$ are each lower alkylene, $n$ is from 5 to 28, said composition being deposited as a dispersion in a volatile liquid carrier and then curing the substrate by heating it at a temperature of about 150° C. for 3 minutes.

The preferred procedure involves depositing on the textiles, a composition comprising (a) from about 0.6% to about 1.8% by weight of a mixture of perfluoroalkyl urethane and a copolymer of a perfluoroalkyl acrylate and a hydrocarbylacrylate in a solvent or a copolymer of $R_f$-fumarate mixture and ethylene-propylene-1,5-hexadiene terpolymer rubber and 4-hydroxybutylvinyl ether in a solvent or a copolymer of 1,1-dihydropentadecafluorooctyl methacrylate and ethylenepropylene-1,5-hexadiene terpolymer rubber and 4-hydroxybutylvinyl ether in a solvent and (b) from about 0.25% to about 0.75% by weight of a copolymer of 2-methoxy-propene-maleic-anhydride copolymer, stearyl amine and an aminoorganopolysiloxane of formula III wherein $R_2$ is methyl, $R_3$ is propylene and $R_4$ is ethylene and $n$ is from 5 to 20, said composition being deposited as a dispersion in perchloroethylene carrier and then curing the textiles by heating it at a temperature of 150° for 3 minutes. In the above procedure, by varying the concentration of copolymer in solution, the amount of copolymer deposited on the substrate may be varied. Typically, the amount of copolymer may be from 0.1 to 1% based on the weight of the substrates but the preferred percentage weights are 0.25, 0.5, or 0.75 in treating textiles such as fabrics. After application of the composition, the treated substrate is subjected to a curing operation in order to provide cross-linking of the copolymer by hydrolysis of the alkoxy groups and thereby increasing the bonding of the composition on to the fibers, as well as providing durability. The curing operation consists in heating the substrate to 150° C. for about 3 minutes. The carrier from the composition solution may be evaporated in a separate step prior to curing or it may simply be evaporated during the curing operation.

The present invention also relates to a dried article of manufacture, namely fibrous material carrying a deposit of the compolymer composition of the invention for the purpose of increasing its water and oil repellency and which comprises (a) about 0.2% to about 2.0% by weight of a textile treating resin and from 0.15% to 1.0% by weight of (b) a copolymer obtained from reacting (I) a maleic-anhydride copolymer of the formula

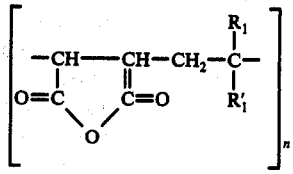

wherein each of $R_1$ and $R_1'$ is hydrogen, lower alkyl, lower alkoxy, or aryl, $n$ is an integer from 2 to 30, (II) an amine derived from fatty acid and of the formula $$CH_3\text{-}(CH_2)_p\text{-}NH_2$$

wherein $p$ is an integer from 7 to 28, and (III) an aminoorganopolysiloxane of the formula

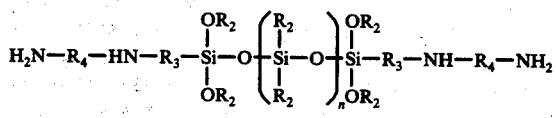

wherein $R_2$ is lower alkyl, $R_3$ and $R_4$ are each lower alkylene and $n$ is an integer from 5 to 28.

Suitable fibrous materials carrying a deposit of the preferred copolymer composition on account of its usefulness are textiles and especially fabrics of cotton or mixtures of polyester/cotton. Said preferred composition is that comprising (a) from about 0.6% to about 1.8% by weight of a mixture of perfluoroalkyl urethane and a copolymer of a perfluoroalkyl acrylate and a hydrocarbylacrylate in a solvent or a copolymer of $R_f$-fumarate mixture and ethylene-propylene-1,5-hexadiene terpolymer rubber and 4-hydroxybutylvinyl ether in a solvent or a copolymer of 1,1-dihydropentadecafluorooctyl methacrylate and ethylene-propylene-1,5-hexadiene terpolymer rubber and 4-hydroxybutylvinyl ether in a solvent, and (b) a copolymer obtained from reacting (I) a maleic-anhydride-2-methoxypropene copolymer, (II) a stearyl amine and (III) an aminoorganopolysiloxane wherein $R_2$ is methyl, $R_3$ is propylene and $R_4$ is ethylene and $n$ is from 5 to 20.

The usefulness of the copolymer compositions is, however, conveniently shown by measuring the oil, water repellency ratings of substrates such as fabrics, paper, leather etc. which are treated with solutions of the novel composition.

The invention described above is illustrated by the following examples. All parts are by weight and degrees are in centigrades. Examples 1 to 8 illustrate the preparation of the new copolymers. Example 9 illustrates the preparation of novel copolymer compositions and the present, practical utility of such compositions.

EXAMPLE 1

A mixture of 20.0 g of maleic-anhydride-2-methoxypropene copolymer of average molecular weight 7,800 with ratio of weight to number average i.e. $M_w/M_n$ = 4.2 (prepared by the known process of free radical initiated polymerization of maleic-anhydride and 2,2-dimethoxy propane) and 120.0 g of dioxane is heated to 45°, while maintaining a nitrogen atmosphere. Then to the solution is added 21.4 g of stearyl amine and the resulting mixture is heated to 80°. After that, 15.1 g of aminoorganopolysiloxane having a viscosity of 35 cs at 25° C (aminosiloxane supplied by Dow Corning, designated as Dow Corning 536 fluid) is added to the solution and the resulting mixture is heated to 100°. The solution is refluxed at 100° for 3½ hours. The solution is cooled to yield a N-substituted maleamic acid copolymer, the reaction product of maleic anhydride-2-methoxy propene copolymer, stearyl amine and aminosiloxane. This copolymer is diluted with 260.0 g of perchloroethylene. This solution had a solid content of 12.0%. For analysis a sample of this copolymer was obtained by precipitating it from a mixture of methanol and ethanol (4:1). The sample had an elemental analysis of C:60.31%, H:10.11%, and N:2.86%.

To the above copolymer solution in perchloroethylene is added the fluorine polymer and the resulting solution is applied.

EXAMPLE 2

A mixture of 20.0 g of the above maleic anhydride-2-methoxypropene copolymer and 120.0 g of dioxane is heated to 45°, while maintaining a nitrogen atmosphere. Then to the solution is added 24.2 g of stearyl amine and the resulting mixture is heated to 80°. After that, 7.5 g of aminoorganopolysiloxane (previously described in Example 1) is added to the solution and the resulting mixture is refluxed for 3 hours during which time a clear solution is obtained. The solution is cooled to yield the N-substituted maleamic acid copolymer, the reaction product of maleic anhydride-2-methoxypropene copolymer, stearyl amine and aminosiloxane. This copolymer is diluted with 220.0 g of perchloroethylene and used as described in Example 1. This solution had a solid content of 12.5%. For analysis a sample of this copolymer was obtained by precipitating it from a mixture of methanol and ethanol (4:1). The sample had an elemental analysis of C:65.63%, H:10.69%, N:2.98%.

EXAMPLE 3

A mixture of 20.0 g of maleic-anhydride-2-methoxypropene copolymer (of Example 1) and 120.0 g of dioxane is heated to 45°, while maintaining a nitrogen atmosphere. Then to the solution is added 29.3 g of hydrogenated tallow amine (supplied by Ashland Chemical Co., designated as Adogen 140) and the resulting mixture is heated to 80°. After that, 7.5 g of aminoorganopolysiloxane (of Example 1) is added to the solution and the resulting mixture is refluxed for 3 hours. The solution is cooled to yield a copolymer, the reaction product of maleic anhydride-2-methoxypropene copolymer, hydrogenated tallow amine and aminosiloxane. This copolymer is diluted with 150.0 g of perchloroethylene and used as described previously. This solution had a solid content of 12.0%. For analysis a sample of this copolymer was obtained by precipitating it from a mixture of methanol and ethanol (4:1). The sample had an elemental analysis of C:67.62%, H:10.85%, N:3.09%.

EXAMPLE 4

The new copolymer, the reaction product of maleic-anhydride-2-methoxypropene copolymer, stearyl amine and aminosiloxane is obtained using the exact procedure of Example 2 as well as the same amounts as in Example 2 of maleic-anhydride-2-methoxypropene copolymer, stearyl amine, and dioxane but instead of Dow Corning 536 fluid, is used 23.2 g of aminoorganopolysiloxane of viscosity 150 cs at 25° C (supplied by Dow Corning Corporation and designated as Dow Corning 531 fluid). The new copolymer is diluted with 100.0 g of perchloroethylene. This solution had a solid content of 12.0%. For analysis a sample of this copolymer was obtained by precipitating it from a mixture of methanol and ethanol (4:1). The sample had an elemental analysis of C:60.45%, H:10.26%, N:2.47%.

EXAMPLE 5

Following the procedure of Example 2 and using the same amounts of other reactants as of Example 2 but substituting for Dow Corning 536 fluid, an aminosiloxane of viscosity 80 cs at 25° (supplied as a 50% solution of aliphatic solvent and isopropylalcohol by Dow Corning, designated as Dow Corning 530 fluid), the new N-substituted maleamic acid copolymer, the reaction product of maleic anhydride-2-methoxypropene copolymer, stearyl amine and aminosiloxane is obtained. This copolymer is diluted with 200.0 g of perchloroethylene. This solution had a solid content of 12.6%. For analysis a sample of this copolymer was obtained by precipitating it from a mixture of methanol and ethanol (4:1). The sample had an elemental analysis of C:65.08%, H:10.53%, N:3.18%.

EXAMPLE 6

A mixture of 25.2 g of maleic-anhydride-ethylene copolymer of average molecular weight of about 9,000, with a ratio of weight to number average i.e., $M_w/M_n$ = 2.9 (supplied by Monsanto Chemical Company) and 240.0 g of dioxane is heated to 95°, while maintaining a nitrogen atmosphere. Then to the mixture is added 49.4 g of stearyl amine at 95°, all in one portion. To the resulting solution is added 15.0 g of aminosiloxane (of Example 1) at 95° and the resulting mixture is refluxed for 2.20 hours. The mixture is cooled to give the N-substituted maleamic acid copolymer, the reaction product of maleic anhydride methoxypropene copolymer, stearyl amine and aminosiloxane. This copolymer is diluted with 300.0 g of perchloroethylene. This solution had a solid content of 12.0%. For analysis a sample of this copolymer was obtained by precipitating it from a mixture of methanol and ethanol (4:1). The sample had an elemental analysis of C:68.01%, H:11.12%, N:3.30%.

EXAMPLE 7

A mixture of 21.5 g of maleic-anhydride-styrene copolymer of average molecular weight of about 3,800 with a ratio of weight to number average i.e., $M_w/M_n$ = 24 (supplied by Arco Chemical Co.) and 120.0 g of dioxane is heated to 45°, while maintaining a nitrogen atmosphere. Then to the solution is added 24.7 g of stearyl amine and the resulting mixture is heated to 80°. After that 7.8 g of aminosiloxane of Example 1 is added at 80° and the resulting solution is maintained at 80° for one hour. Then the solution is heated to reflux and refluxed for 2 hours. The solution is cooled to give the N-substituted maleamic acid copolymer, the reaction product of maleic anhydride styrene copolymer, stearyl amine and aminosiloxane. This solution had a solid content of 24.4%. For analysis a sample of this copolymer was obtained by precipitating it from a mixture of methanol and ethanol (4:1). The sample had an elemental analysis of C:71.29, H:10.25%, N:2.83%.

EXAMPLE 8

A mixture of 21.5 g of maleic anhydride-styrene copolymer (of Example 7) and 120.0 g of dioxane is heated to 95°, while maintaining a nitrogen atmosphere. Then to the mixture is added 15.5 g of aminosiloxane (of Example 1) at 95° and then the mixture is heated to reflux and refluxed for three hours. The mixture is cooled to yield the N-substituted maleamic acid copolymer, the reaction product of maleic anhydride styrene copolymer, stearyl amine and aminosiloxane. This copolymer is diluted with 48.0 g of perchloroethylene. This solution had a solid content of 24.4%. For analysis a sample of this copolymer was obtained by precipitating it from a mixture of methanol and ethanol (4:1). The sample had an elemental analysis of C:66.03%, H:9.4%, N:2.53%.

EXAMPLE 9

The utility of the novel copolymers of the preceding Examples is illustrated below. The new copolymers and the fluorine polymers are applied to the fabric at 0.6% to 1.8% of the fluorine polymers corresponding to 0.05% to 0.08%F based on the weight of fabric (% F OWF) and 0.25%, 0.50%, 0.75% or 1.0% of the new copolymers, the percentage weights based on the weight of the bath (OWB), and the fabric is tested for initial oil and water repellency and also tested for oil and water repellency after several launderings and dry cleanings.

The AATCC water spray test rating is determined according to Standard Test Method 22-1971 of the American Association of Textile Chemists and Colorists. Ratings are given from 0 (minimum) to 100 (maximum).

The AATCC Oil Rating is determined according to Standard Test Method 118-1972 of the American Association of Textile Chemists and Colorists. Ratings are given from 0 (minimum) to 8 (maximum). The oil rating is also determined according to 3M Company test method.

All mentioned AATC Tests are listed in the Technical Manual of the American Association of Textile Chemists and Colorists, Volume 48, Edition 1972.

The novel copolymer compositions are applied to polyester-cotton poplin (65/35) or to cotton fabric (100%) in such a way that 0.6% to 1.8% fluorine polymers corresponding to 0.05% to 0.08%F (% F OWF) and 0.25%, 0.5%, 0.75% or 1% of the new copolymers were deposited on the fabric. The cotton/polyester fabric is a 65% polyester-35% cotton blend. The polyester is one formed from ethylene glycol and terephthalic acid, sold for example under the Dacron trademark.

The fluorine polymers and the new copolymers are dissolved in a non-aqueous medium; namely, perchloroethylene and are mostly applied to the fabric by a padding process and are evaluated after air drying and after curing in a hot air oven at 150° for 3 minutes.

The evaluation of several compositions of new copolymers (extenders) with different fluorine polymers are listed in various tables below. The pad applications are made from solvent using perchloroethylene. The fabric is 35% cotton (poplin), 65% polyester or cotton (100%). The fluorine polymer concentrations and amount of new copolymers (extenders) are expressed as percentages on weight of bath (OWB).

In Table I, are listed the percentage compositions of the fluorine polymers and the extenders of Examples 1 and 2. The fluorine polymers are a copolymer of $R_f$-fumarate mixture and ethylene-propylene-1,5-hexadiene terpolymer rubber and 4-hydroxybutylvinyl ether or a mixture of perfluoroalkyl urethane and a copolymer of a perfluoroalkyl acrylate and a hydrocarbylacrylate. The wet pickup is 50% and the concentrations of fluorine polymers are 1.8% (OWB) and which corresponds to 0.08% of fluorine on the weight of fabric (% F OWF). The amount of extenders are 0.25%, 0.5% and 0.75% on weight of the bath.

In Table II are listed the oil and water repellency ratings of the compositions listed in Table I. The fabric is 35% cotton (poplin)/65% polyester and the oil repellency ratings are evaluated by the AATCC method.

In Table III are listed the percentage compositions of the fluorine polymers and the extenders of Examples 6, 7 and 8.

The fluorine polymers are the same as in Table I. The wet pickup is 80% on 35% cotton (poplin)/65% polyester fabric and 114% on cotton (100%). The concentration of fluorine polymers are 0.6% and 1.1% (OWB) and which corresponds to about 0.05% of fluorine on the weight of fabric (% F OWF). The amount of extenders are 0.25%, 0.5%, 0.75% and 1.0% on weight of the bath.

In Table IV are listed the oil repellency ratings of the compositions listed in Table III. The fabric is the same as in Table II and the oil repellency ratings are evaluated by two methods namely by AATCC method as well as by 3M Co. method.

In Table V are listed the oil repellency ratings of the compositions listed in Table III. The fabric is cotton (100%) and the ratings are evaluated by the methods of AATCC and 3M Co.

In Table VI are listed the water repellency ratings of the compositions listed in Table III. The fabric is the same as in Table II and the water ratings are evaluated by the method of AATCC Water Spray Test.

In Table VII are listed the water repellency ratings of the compositions listed in Table III. The fabric is cotton (100%) and the water ratings are evaluated by the method of AATCC Water Spray Test.

Table I

Percentage Compositions of fluorine polymers and extenders of Examples 1 and 2

$R_f$-fumarate mixture = fluorine polymer of a copolymer of $R_f$-fumarate mixture and ethylene-polylene-1,5-hexadiene terpolymer rubber and 4-hydroxybutylvinylether Perfluoroalkyl urethane mixture = fluorine polymer of a mixture of perfluoroalkyl urethane and a copolymer of a perfluoroalkyl acrylate and a hydrocarbyl acrylate OWB = percentage on weight of bath

| Sample No. | Composition, %(OWB) $R_f$-fumarate mixture | Composition, %(OWB) Perfluoroalkyl urethane mixture | Composition, %(OWB) extenders of Example 1 | Composition, %(OWB) extenders of Example 2 |
|---|---|---|---|---|
| 1 | 1.8% | — | — | — |
| 2 | 1.8% | — | 0.25% | — |
| 3 | 1.8% | — | 0.5% | — |
| 4 | 1.8% | — | 0.75% | — |
| 5 | 1.8% | — | — | 0.25% |
| 6 | 1.8% | — | — | 0.5% |
| 7 | 1.8% | — | — | 0.75% |

Table I-continued

Percentage Compositions of fluorine polymers and extenders of Examples 1 and 2

$R_f$-fumarate mixture = fluorine polymer of a copolymer of $R_f$-fumarate mixture and ethylene-polylene-1,5-hexadiene terpolymer rubber and 4-hydroxybutylvinylether Perfluoroalkyl urethane mixture = fluorine polymer of a mixture of perfluoroalkyl urethane and a copolymer of a perfluoroalkyl acrylate and a hydrocarbyl acrylate OWB = percentage on weight of bath

| Sample No. | Composition, %(OWB) $R_f$-fumarate mixture | Composition, %(OWB) Perfluoroalkyl urethane mixture | Composition, %(OWB) extenders of Example 1 | Composition, %(OWB) extenders of Example 2 |
|---|---|---|---|---|
| 8 | — | 1.8% | — | — |
| 9 | — | 1.8% | 0.25% | — |
| 10 | — | 1.8% | 0.5% | — |
| 11 | — | 1.8% | 0.75% | — |
| 12 | — | 1.8% | — | 0.25% |
| 13 | — | 1.8% | — | 0.5% |
| 14 | — | 1.8% | — | 0.75% |

Table II

Oil and Water Repellency Ratings of Compositions of Table I on cotton/polyester fabric by AATCC method

| Sample No. | Initial Oil Repellency | Initial Water Repellency | After 3 Washes Oil Repellency | After 3 Washes Water Repellency | After 3 Dry Cleanings Oil Repellency | After 3 Dry Cleanings Water Repellency |
|---|---|---|---|---|---|---|
| 1 | 6 | 70 | 2 | 50 | 3 | 70 |
| 2 | 8 | 80 | 3 | 60 | 5 | 80 |
| 3 | 8 | 80 | 3 | 60 | 6 | 80 |
| 4 | 8 | 80 | 3 | 60 | 6 | 80 |
| 5 | 8 | 90 | 4 | 60 | 5 | 80 |
| 6 | 8 | 90 | 4 | 60 | 4 | 80 |
| 7 | 8 | 90 | 3 | 70 | 2 | 80 |
| 8 | 4 | 80 | 2 | 60 | 1 | 80 |
| 9 | 5 | 90 | 4 | 70 | 1 | 80 |
| 10 | 5 | 90 | 3 | 60 | 1 | 80 |
| 11 | 6 | 90 | 2 | 60 | 1 | 80 |
| 12 | 5 | 90 | 3 | 60 | 1 | 80 |
| 13 | 6 | 90 | 2 | 70 | 0 | 80 |
| 14 | 6 | 90 | 2 | 70 | 0 | 80 |

Table IV-continued

Oil Repellency Ratings of Compositions of Table III on cotton/polyester fabric by AATCC and 3M Co. method

| Sample No. | AATCC method Initial | AATCC method 1/3 Washes | AATCC method 3 Dry Cleanings | 3M Co. method Initial | 3M Co. method 1/3 Washes | 3M Co. method 3 Dry Cleanings |
|---|---|---|---|---|---|---|
| 21 | 4 | 2/1 | 0 | 100 | 60/50 | 0 |
| 22 | 4 | 1/1 | 0 | 100 | 70/50 | 0 |
| 23 | 8 | 5/5 | 4 | 140 | 110/90 | 110 |
| 24 | 8 | 5/5 | 4 | 150 | 110/90 | 110 |
| 25 | 8 | 5/5 | 4 | 150 | 120/40 | 110 |
| 26 | 8 | 5/4 | 5 | 150 | 110/110 | 110 |
| 27 | 6 | 2/1 | 2 | 120 | 80/50 | 80 |
| 28 | 6 | 2/2 | 1 | 120 | 70/50 | 60 |
| 29 | 6 | 2/1 | 2 | 120 | 60/50 | 90 |
| 30 | 6 | 2/1 | 1 | 120 | 60/50 | 60 |
| 31 | 7 | 2/1 | 2 | 130 | 80/80 | 80 |
| 32 | 7 | 2/1 | 2 | 120 | 60/50 | 70 |
| 33 | 6 | 1/1 | 1 | 120 | 50/50 | 70 |
| 34 | 6 | 1/1 | 1 | 120 | 50/50 | 70 |
| 35 | 5 | 5/2 | 0 | 110 | 110/70 | 0 |
| 36 | 5 | 4/3 | 1 | 110 | 100/80 | 50 |
| 37 | 5 | 2/3 | 1 | 110 | 90/80 | 50 |
| 38 | 5 | 2/3 | 1 | 110 | 110/80 | 50 |

Table III

Percentage Compositions of fluorine polymers and extenders of Examples 6, 7 and 8

| Sample No. | Composition, %(OWB) $R_f$-fumarate mixture | Composition, %(OWB) Perfluoroalkyl urethane mixture | Composition, %(OWB) extenders of Example 7 | Composition, %(OWB) extenders of Example 8 | Composition, %(OWB) extenders of Example 6 |
|---|---|---|---|---|---|
| 15 | 1.1 | — | 0.25 | — | — |
| 16 | 1.1 | — | 0.5 | — | — |
| 17 | 1.1 | — | 0.75 | — | — |
| 18 | 1.1 | — | 1.0 | — | — |
| 19 | 1.1 | — | — | 0.25 | — |
| 20 | 1.1 | — | — | 0.5 | — |
| 21 | 1.1 | — | — | 0.75 | — |
| 22 | 1.1 | — | — | 1.0 | — |
| 23 | 1.1 | — | — | — | 0.25 |
| 24 | 1.1 | — | — | — | 0.5 |
| 25 | 1.1 | — | — | — | 0.75 |
| 26 | 1.1 | — | — | — | 1.0 |
| 27 | — | 0.6 | 0.25 | — | — |
| 28 | — | 0.6 | 0.5 | — | — |
| 29 | — | 0.6 | 0.75 | — | — |
| 30 | — | 0.6 | 1.0 | — | — |
| 31 | — | 0.6 | — | 0.25 | — |
| 32 | — | 0.6 | — | 0.5 | — |
| 33 | — | 0.6 | — | 0.75 | — |
| 34 | — | 0.6 | — | 1.0 | — |
| 35 | — | 0.6 | — | — | 0.25 |
| 36 | — | 0.6 | — | — | 0.5 |
| 37 | — | 0.6 | — | — | 0.75 |
| 38 | — | 0.6 | — | — | 1.0 |

Table IV

Oil Repellency Ratings of Compositions of Table III on cotton/polyester fabric by AATCC and 3M Co. method

| Sample No. | AATCC method Initial | AATCC method 1/3 Washes | AATCC method 3 Dry Cleanings | 3M Co. method Initial | 3M Co. method 1/3 Washes | 3M Co. method 3 Dry Cleanings |
|---|---|---|---|---|---|---|
| 15 | 5 | 2/1 | 0 | 110 | 80/90 | 0 |
| 16 | 5 | 2/1 | 0 | 110 | 70/50 | 0 |
| 17 | 5 | 2/1 | 0 | 110 | 70/50 | 0 |
| 18 | 5 | 1/1 | 0 | 110 | 50/50 | 0 |
| 19 | 4 | 2/2 | 0 | 100 | 70/60 | 0 |
| 20 | 4 | 2/1 | 0 | 100 | 60/50 | 0 |

Table V

Oil Repellency Ratings of Composition of Table III on cotton fabric (100%) by AATCC and 3M Co. method

| Sample No. | AATCC method Initial | AATCC method 1/3 Washes | AATCC method 3 Dry Cleanings | 3M Co. method Initial | 3M Co. method 1/3 Washes | 3M Co. method 3 Dry Cleanings |
|---|---|---|---|---|---|---|
| 15 | 5 | 3/2 | 2 | 110 | 90/70 | 80 |
| 16 | 5 | 2/1 | 1 | 110 | 70/50 | 60 |
| 17 | 5 | 2/1 | 1 | 110 | 70/50 | 50 |
| 18 | 5 | 2/1 | 2 | 110 | 60/50 | 60 |

Table V-continued

Oil Repellency Ratings of Composition of Table III on cotton fabric (100%) by AATCC and 3M Co. method

| Sample No. | AATCC method Initial | AATCC method 1/3 Washes | AATCC method 3 Dry Cleanings | 3M Co. method Initial | 3M Co. method 1/3 Washes | 3M Co. method 3 Dry Cleanings |
|---|---|---|---|---|---|---|
| 19 | 5 | 2/2 | 2 | 110 | 70/60 | 70 |
| 20 | 5 | 2/1 | 2 | 110 | 80/60 | 80 |
| 21 | 5 | 2/1 | 2 | 110 | 70/50 | 70 |
| 22 | 5 | 2/1 | 2 | 110 | 70/60 | 60 |
| 23 | 8 | 6/5 | 6 | 140 | 120/110 | 110 |
| 24 | 8 | 6/5 | 6 | 140 | 110/110 | 110 |
| 25 | 8 | 5/4 | 5 | 140 | 120/110 | 110 |
| 26 | 8 | 5/4 | 5 | 150 | 100/110 | 110 |
| 27 | 8 | 4/2 | 4 | 150 | 90/70 | 90 |
| 28 | 8 | 3/2 | 2 | 150 | 90/60 | 90 |
| 29 | 7 | 2/1 | 2 | 140 | 70/50 | 80 |
| 30 | 8 | 2/1 | 3 | 140 | 70/50 | 90 |
| 31 | 8 | 4/2 | 5 | 140 | 90/70 | 100 |
| 32 | 8 | 4/2 | 5 | 140 | 90/60 | 100 |
| 33 | 7 | 2/1 | 4 | 140 | 70/50 | 100 |
| 34 | 7 | 2/1 | 2 | 130 | 70/50 | 100 |
| 35 | 6 | 4/2 | 1 | 110 | 100/90 | 50 |
| 36 | 6 | 4/2 | 2 | 110 | 90/90 | 60 |
| 37 | 6 | 4/2 | 1 | 110 | 90/90 | 50 |
| 38 | 6 | 3/2 | 1 | 110 | 80/90 | 50 |

Table VI

Water Repellency Ratings of Compositions of Table III on cotton/polyester fabric by the Spray Rating method

| Sample No. | Initial | 1/3 Washes | 3 Dry Cleanings |
|---|---|---|---|
| 15 | 90 | 70/50 | 70 |
| 16 | 75 | 70/50 | 70 |
| 17 | 75 | 70/0 | 70 |
| 18 | 75 | 50/0 | 70 |
| 19 | 80 | 70/50 | 70 |
| 20 | 70 | 70/50 | 50 |
| 21 | 85 | 70/50 | 70 |
| 22 | 75 | 50/50 | 70 |
| 23 | 100 | 95/95 | 90 |
| 24 | 95 | 90/95 | 95 |
| 25 | 100 | 90/95 | 95 |
| 26 | 100 | 90/90 | 95 |
| 27 | 80 | 70/0 | 70 |
| 28 | 70 | 70/50 | 70 |
| 29 | 70 | 70/50 | 70 |
| 30 | 70 | 70/50 | 70 |
| 31 | 75 | 70/50 | 70 |
| 32 | 70 | 50/0 | 70 |
| 33 | 85 | 70/50 | 70 |
| 34 | 75 | 50/50 | 70 |
| 35 | 100 | 90/95 | 90 |
| 36 | 100 | 95/95 | 85 |
| 37 | 95 | 95/95 | 90 |
| 38 | 95 | 90/95 | 85 |

Table VII

Water Repellency Ratings of Compositions of Table III on cotton fabric (100%) by the Spray Rating method

| Sample No. | Initial | 1/3 Washes | 3 Dry Cleanings |
|---|---|---|---|
| 15 | 70 | 50/0 | 70 |
| 16 | 70 | 50/0 | 70 |
| 17 | 70 | 50/0 | 70 |
| 18 | 70 | 50/0 | 60 |
| 19 | 70 | 50/0 | 70 |
| 20 | 70 | 50/0 | 70 |
| 21 | 70 | 50/0 | 70 |
| 22 | 70 | 50/50 | 70 |
| 23 | 85 | 80/80 | 90 |
| 24 | 85 | 80/80 | 80 |
| 25 | 85 | 80/80 | 80 |
| 26 | 85 | 80/80 | 90 |
| 27 | 70 | 50/0 | 75 |
| 28 | 70 | 50/0 | 70 |
| 29 | 75 | 50/0 | 70 |
| 30 | 70 | 50/0 | 70 |
| 31 | 75 | 50/50 | 75 |
| 32 | 75 | 50/50 | 70 |
| 33 | 75 | 50/50 | 70 |
| 34 | 75 | 50/50 | 70 |
| 35 | 85 | 80/80 | 75 |
| 36 | 85 | 75/80 | 80 |
| 37 | 85 | 80/75 | 75 |
| 38 | 85 | 80/80 | 75 |

I claim:

1. A composition comprising a) from about 0.02 weight % to about 2.0 weight % of a textile treating resin which is a fluorine-containing polymer of any polymeric or polymer-forming perfluoroalkyl-group-containing compound, sufficient to impart oil or water repellency to a textile fabric and b) from about 0.15 weight % to about 10 weight % of a copolymer of (I) a maleic-anhydride copolymer of the formula

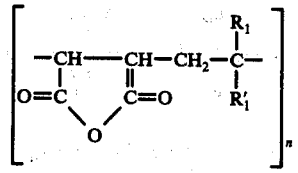

wherein each of $R_1$ and $R_1'$ is hydrogen, lower alkyl, lower alkoxy, or aryl, and $n$ is an integer from 2 to 30, (II) an amine derived from fatty acid and of the formula $CH_3\text{-}(CH_2)_p\text{-}NH_2$, wherein $p$ is an integer from 7 to 28, and (III) an aminoorganopolysiloxane of the formula

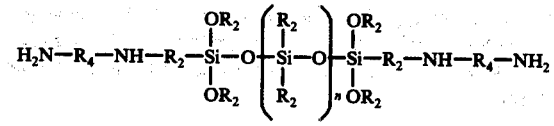

wherein $R_2$ is lower alkyl, $R_3$ and $R_4$ are each lower alkylene, and $n$ is an integer from 5 to 28.

2. A composition of claim 1, comprising a) from about 0.6 weight % to about 1.8 weight % of the fluorine-containing polymer and b) from about 0.25 weight % to about 0.75 weight % of a copolymer of (I) a maleic-anhydride copolymer of the formula

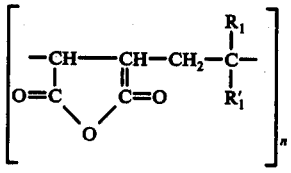

wherein each of $R_1$ and $R_1'$ is hydrogen, methyl, ethyl, methoxy, ethoxy or phenyl, $n$ is an integer from 2 to 30, (II) an amine derived from fatty acid and of the formula $CH_3\text{-}(CH_2)_p\text{-}NH_2$ wherein $p$ is an integer from 12 to 26 and (III) an aminoorganopolysiloxane of the formula

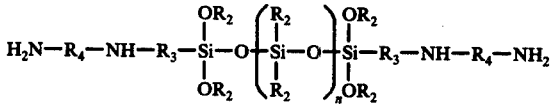

wherein $R_2$ is methyl, ethyl, propyl, butyl, $R_3$ and $R_4$ each are methylene, ethylene, propylene or butylene and $n$ is an integer from 5 to 20.

3. A composition of claim 1, comprising a) from about 0.6 weight % to about 1.1 weight % of a mixture of perfluoroalkyl urethane and a copolymer of a perfluoroalkyl acrylate and a hydrocarbylacrylate or a copolymer of $R_f$-fumarate mixture and ethylene-propylene-1,5-hexadiene terpolymer rubber and 4-hydroxybutylvinylether and b) from about 0.25 weight % to about 0.75 weight % of a copolymer of (I) a maleic-anhydride copolymer selected from the group consisting of maleic-anhydride-2-methoxypropene, maleic-anhydride-ethylene, maleic-anhydride-vinyl ether or maleic-anhydride-styrene, (II) an amine selected from the group consisting of stearyl or hydrogenated tallow, and (III) an aminoorganopolysiloxane of the formula

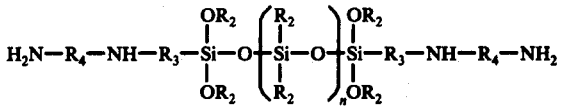

wherein $R_2$ is methyl or ethyl, $R_3$ and $R_4$ are each methylene, ethylene, or propylene and $n$ is from 5 to 20.

4. A composition of claim 1, comprising a) from about 0.6 weight % to about 1.8 weight % of a mixture of perfluoroalkyl urethane and a copolymer of a perfluoroalkyl acrylate and a hydrocarbylacrylate or a copolymer of $R_f$-fumarate mixture and ethylene-propylene-1,5-hexadiene terpolymer rubber and 4-hydroxybutylvinylether and b) from about 0.25 weight % to about 0.75 weight % of a copolymer of (I) a maleic-anhydride-2-methoxypropene copolymer, (II) stearyl amine and (III) and aminoorganopolysiloxane of the formula

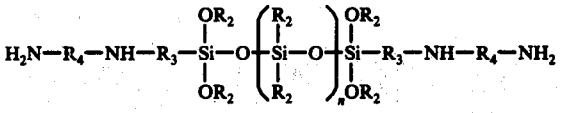

wherein $R_2$ is methyl, $R_3$ is propylene, $R_4$ is ethylene and $n$ is from 5 to 20.

5. A process for the manufacture of a copolymer of (I), (II) and (III) of claim 1, comprising the steps of refluxing a maleic-anhydride copolymer (I) with an amine (II) and an aminoorganopolysiloxane (III), in molar ratios having an excess of II in an organic solvent inert to the reactants, then cooling the mixture and obtaining a viscous product.

6. A process of claim 5, comprising the steps of refluxing a copolymer (I) selected from the group consisting of maleic-anhydride-2-methoxypropene, maleic-anhydride-ethylene, maleic-anhydride-vinylether or maleic-anhydride styrene, with stearyl amine (II) and an aminoorganopolysiloxane (III) of the formula

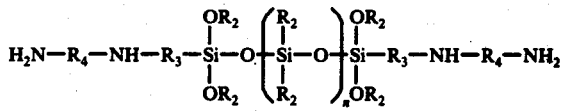

wherein $R_2$ is methyl, $R_3$ is propylene and $R_4$ is ethylene and $n$ is from 5 to 20 in an organic solvent inert to the reactants, then cooling the mixture and obtaining a viscous product.

7. A process of claim 5, wherein the refluxing is carried out in organic solvent selected from the group consisting of halogen containing hydrocarbons with 2 to 4 carbon atoms, cyclic ethers, benzene or substituted benzene or mixtures of said solvents.

8. A process of claim 5, wherein the solvents are dioxane, toluene, ethylenedichloride, perchloroethylene, benzene or mixtures of said solvents.

9. A process of claim 5, wherein the molar ratio of (II) to (III) is 9:1.

10. A process of claim 5, wherein the molar ratio of (II) to (III) is 8:2.

11. A process for treating textiles for the purpose of imparting increased oil and water repellency thereto, comprising impregnating said textiles, with a composition of claim 1, and drying said textiles.

12. A dried textile which is treated with the composition of claim 1.

* * * * *

UNITED STATES PATENT AND TRADEMARK OFFICE

CERTIFICATE OF CORRECTION

PATENT NO. : 4,070,152

DATED : January 24, 1978

INVENTOR(S) : Lipot Pentz

It is certified that error appears in the above-identified patent and that said Letters Patent are hereby corrected as shown below:

In claims 1 and 2, Column 22, lines 10-15 and lines 40-45, the formula:

"

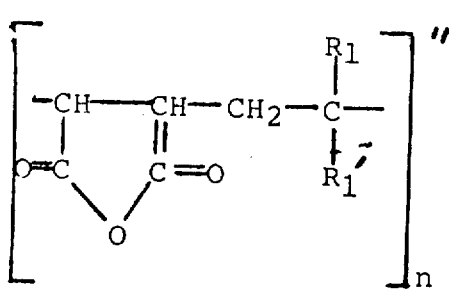

"

should read

--

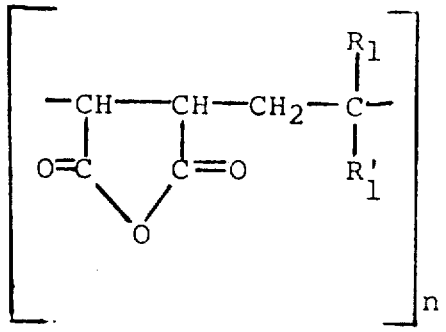

--.

Signed and Sealed this

Sixth Day of May 1980

[SEAL]

Attest:

SIDNEY A. DIAMOND

Attesting Officer

Commissioner of Patents and Trademarks